US010403257B2

(12) United States Patent
Kikuchi et al.

(10) Patent No.: US 10,403,257 B2
(45) Date of Patent: Sep. 3, 2019

(54) SOUND DEADENING DEVICE

(71) Applicant: Kobe Steel, Ltd., Hyogo (JP)

(72) Inventors: Masahiro Kikuchi, Kobe (JP); Kazuki Tsugihashi, Kobe (JP); Yosuke Fukushima, Kobe (JP); Kazuya Hirata, Hyogo (JP); Suguru Kiuchi, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 269 days.

(21) Appl. No.: 15/547,701

(22) PCT Filed: Jan. 4, 2016

(86) PCT No.: PCT/JP2016/050044
§ 371 (c)(1),
(2) Date: Jul. 31, 2017

(87) PCT Pub. No.: WO2016/125505
PCT Pub. Date: Aug. 11, 2016

(65) Prior Publication Data

US 2018/0025714 A1 Jan. 25, 2018

(30) Foreign Application Priority Data

Feb. 4, 2015 (JP) ..... 2015-020473

(51) Int. Cl.
*G10K 11/16* (2006.01)
*F04C 29/06* (2006.01)
(Continued)

(52) U.S. Cl.
CPC ..... *G10K 11/161* (2013.01); *F04C 29/065* (2013.01); *G10K 11/172* (2013.01); *F04C 18/16* (2013.01); *F04C 29/12* (2013.01)

(58) Field of Classification Search
CPC ... G10K 11/161; G10K 11/172; F04C 29/065; F04C 29/12
(Continued)

(56) References Cited

U.S. PATENT DOCUMENTS 5,475,189 A * 12/1995 Field ..... F16L 55/0333 181/241
5,712,454 A 1/1998 Ozawa et al.
(Continued)

FOREIGN PATENT DOCUMENTS

JP S49-128144 A 12/1974
JP S51-42839 A 4/1976
(Continued)

OTHER PUBLICATIONS

International Preliminary Report on Patentability issued in PCT/JP2016/050044; dated Aug. 17, 2017.
(Continued)

*Primary Examiner* — Jeremy A Luks
(74) *Attorney, Agent, or Firm* — Studebaker & Brackett PC

(57) ABSTRACT

A sound deadening device has an introducing and damping section. The introducing and damping section includes an introduction section that introduces fluid, an expansion chamber, and a lead-out section. The expansion chamber is communicated with the introduction section, has a flow passage cross-section larger than a flow passage cross-section of the introduction section, and has protrusions along a travelling direction of a sound wave, resonance of the sound wave being to be suppressed. The lead-out section is communicated with the expansion chamber, has a flow passage cross-section smaller than that of the expansion chamber, and leads out the fluid in a direction different from an introduction direction of the fluid. Accordingly, it is possible to weaken the resonance of the sound wave, suppress rise of inner sound pressure of the sound deadening device, and prevent reduction in a sound deadening effect.

10 Claims, 9 Drawing Sheets

(51) Int. Cl.

| | |
|---|---|
| ***G10K 11/172*** | (2006.01) |
| ***F04C 29/12*** | (2006.01) |
| *F04C 18/16* | (2006.01) |

(58) Field of Classification Search
USPC ..... 181/229, 230
See application file for complete search history.

(56) References Cited

U.S. PATENT DOCUMENTS

| | | | | |
|---|---|---|---|---|
| 6,427,802 | B1 | 8/2002 | Yokoi et al. | |
| 9,449,592 | B2 * | 9/2016 | Dedene | F01N 13/008 |
| 9,938,873 | B2 * | 4/2018 | Bartlett | F01N 13/1872 |
| 10,174,654 | B2 * | 1/2019 | Haberle | F01N 1/083 |

FOREIGN PATENT DOCUMENTS

| | | | |
|---|---|---|---|
| JP | S55-146215 | A | 11/1980 |
| JP | S61-294116 | A | 12/1986 |
| JP | H02-124214 | U | 10/1990 |
| JP | H05-033626 | A | 2/1993 |
| JP | H08-200038 | A | 8/1996 |
| JP | H08-200039 | A | 8/1996 |
| JP | H11-336526 | A | 12/1999 |
| JP | 2001-289167 | A | 10/2001 |

OTHER PUBLICATIONS

International Search Report issued in PCT/JP2016/050044; dated Feb. 9, 2016.

* cited by examiner

SOUND DEADENING DEVICE

CROSS-REFERENCE TO RELATED APPLICATIONS

This is a national phase application in the United States of International Patent Application No. PCT/JP2016/050044 with an international filing date of Jan. 4, 2016, which claims priority of Japanese Patent Application No. 2015-020473 filed on Feb. 4, 2015 the contents of which are incorporated herein by reference.

TECHNICAL FIELD

The present invention relates to a sound deadening device.

BACKGROUND ART

Generation of large sound waves in an outlet space of a compressor is known. From various reasons, it is useful to enable damping of these sound waves.

A sound deadening device having such a sound wave damping function is disclosed in, for example, JP 02-124214 U.

The sound deadening device of JP 02-124214 U includes an introducing pipe, a discharge pipe, and an expansion chamber that is communicated with the introducing pipe and the discharge pipe. In this sound deadening device, rapid change in impedance is generated by cross-section change of the introducing pipe, the expansion chamber, and the discharge pipe, and a sound wave is reflected on the boundaries, so that a sound deadening effect is exerted.

However, in the sound deadening device of JP 02-124214 U, resonance is generated on a facing surface in the direction in which fluid is discharged from the expansion chamber. Accordingly, sound pressure near an outlet becomes high, and the sound deadening effect is lowered.

SUMMARY OT THE INVENTION

Problems to be Solved by the Invention

An object of the present invention is to suppress resonance of a sound wave and improve a sound deadening effect in a sound deadening device.

Means for Solving the Problems

The present invention provides a sound deadening device that includes an introducing and damping section including: an introduction section that introduces fluid; an expansion chamber that is communicated with the introduction section, has a flow passage cross-section larger than a flow passage cross-section of the introduction section, and has a non-flat section on a surface along a travelling direction of a sound wave, resonance of the sound wave being to be suppressed, the introducing and damping section; and a lead-out section that is communicated with the expansion chamber, has a flow passage cross-section smaller than the flow passage cross-section of the expansion chamber, and leads out the fluid in a direction different from an introduction direction of the fluid.

According to this configuration, the non-flat section is provided on an inner wall surface of the sound deadening device, so that it is possible to weaken the resonance of the sound wave, suppress rise of inner sound pressure of the sound deadening device, and prevent reduction in a sound deadening effect. In the sound deadening device, rapid change in impedance is generated by change of the cross-sections of the introduction section, the expansion chamber, and the lead-out section, so that a sound deadening effect resulting from reflection of the sound wave on the boundaries is exerted. However, a sound wave having a predetermined frequency causes resonance with the predetermined frequency inside the expansion chamber. The non-flat section interferes with the sound wave having the frequency at which this resonance is caused, so that it is possible to suppress the resonance. Accordingly, it is possible to suppress rise in the inner sound pressure, and lower the sound deadening effect.

The non-flat section preferably includes a protrusion.

A height of the protrusion is preferably such a height so as not to interfere with a flow passage of the fluid as viewed from the introduction direction of the fluid.

According to this configuration, it is possible to prevent increase of a pressure loss. When the protrusion exists in the flow passage of the fluid, the protrusion becomes an obstacle to the flow, and therefore there is a fear that a pressure loss increases. The height of the protrusion is set to be less than such a height so as not to interfere with the flow passage, so that it is possible to prevent increase of the pressure loss.

The non-flat section may include a recess.

According to this configuration, the recess is provided, so that it is possible to weaken resonance inside the expansion chamber, suppress rise of inner sound pressure of the sound deadening device, and prevent reduction in a sound deadening effect, similarly to the protrusion. Additionally, the recess is provided, so that an effect of a side branch is added.

The recess is preferably composed of a hole, and a blocking plate that blocks the hole.

According to this configuration, it is possible to implement the recess with a simple configuration. In a case where the introducing and damping section is manufactured by casting, sand and the like in the expansion chamber can be discharged by use of the hole. Additionally, even after the sound deadening device is assembled, and installed in a unit, a stick or the like is inserted into each section from the hole to come into contact with each section, so that it is possible to confirm a state and operation of each section.

The non-flat section may include a protrusion and a recess. Additionally, a height of the protrusion is preferably such a height so as not to interfere with a flow passage of the fluid as viewed from the introduction direction of the fluid. The recess is preferably composed of a hole, and a blocking plate that blocks the hole.

A screw hole for fixing the blocking plate is preferably provided in the protrusion.

According to this configuration, it is possible to fix the blocking plate with a bolt by sufficiently hooking a thread without increasing the plate thickness of the sound deadening device body.

An area where the non-flat section is formed is preferably not more than a half of an area where the non-flat section is not formed in an inner wall surface where the non-flat section is formed.

According to this configuration, the formation area of the non-flat section is set to be not more than a half of the non-formation area, so that it is possible to hold the original frequency characteristic of the expansion chamber. The original frequency characteristic of the expansion chamber means a sound deadening characteristic due to interference of a sound wave in the direction perpendicular to the inner wall surface on which the non-flat section is formed. When the formation area of the non-flat section exceeds a predetermined value, the non-flat section itself acts as a wall surface, and therefore the original frequency characteristic of the expansion chamber is lost (changes).

A part of the non-flat section is preferably provided at a center between facing surfaces forming the expansion chamber in the introduction direction of the fluid.

A part of the non-flat section is provided at a central position between the facing surfaces, which causes resonance, so that it is possible to more effectively suppress the resonance inside the expansion chamber. Since particle velocity is the fastest at the central position between the facing surfaces, the non-flat section interferes with particles whose particle velocity is fast, and acts on the particles, so that a larger sound deadening effect can be exerted.

The sound deadening device preferably includes a plurality of damping sections for sound that are disposed in a flow direction of the fluid, wherein the damping section located at an uppermost stream among the plurality of damping sections is preferably the introducing and damping section, the damping section located at a lowermost stream among the plurality of damping sections is preferably a discharging and damping section, and the discharging and damping section preferably includes: a second intermediate communication section that is a portion communicated with an adjacent damping section adjacent to the discharging and damping section; a valve section that is disposed in the discharging and damping section, and is capable of blocking the second intermediate communication section; an urging member that elastically urges the valve section in a direction in which the second intermediate communication section is closed; a valve holder that holds the valve section, and is detachably attached to a housing including the plurality of damping sections; and a discharge section that is provided at a portion different from the valve holder, and leads out the fluid from the discharging and damping section.

According to this configuration, the valve section is disposed inside the discharging and damping section located at the lowermost stream, and therefore the sound deadening device can be made compact. Additionally, a plurality of the damping sections are disposed in the flow direction of the fluid, and the intermediate communication section is provided in the partition section between the damping sections, so that it is possible to damp a sound wave in a wide frequency range. Additionally, the valve section capable of blocking the intermediate communication section is provided in the valve holder of the housing, and therefore it is possible to prevent a reverse flow of the fluid. The valve section is provided in the valve holder that is detachably attached to the housing, and the discharge section is provided in a part other than the valve holder of the housing, and therefore the valve section can be maintained without detaching a pipe disposed on the downstream side of the discharge section. That is, it is possible to damp sound in the wide frequency range, and easily maintain the valve section for preventing the reverse flow of the fluid, with a compact structure.

According to the present invention, a non-flat section is provided on an inner wall surface of a sound deadening device, so that it is possible to suppress resonance of a sound wave, and improve a sound deadening effect.

DESCRIPTION OF EMBODIMENTS

Hereinafter, embodiments of the present invention will be described with reference to the attached drawings. Terms representing directions and positions (such as an "upstream side" and a "downstream side") are used in the following description for convenience' sake, and are used in order to facilitate understanding of the invention. Accordingly, the technical scope of the present invention is not limited by meaning of these terms. Additionally, the following description is merely an exemplification of a mode of the present invention, and does not intend to limit the present invention, application thereof or usage thereof.

(First Embodiment)

Figure 1:
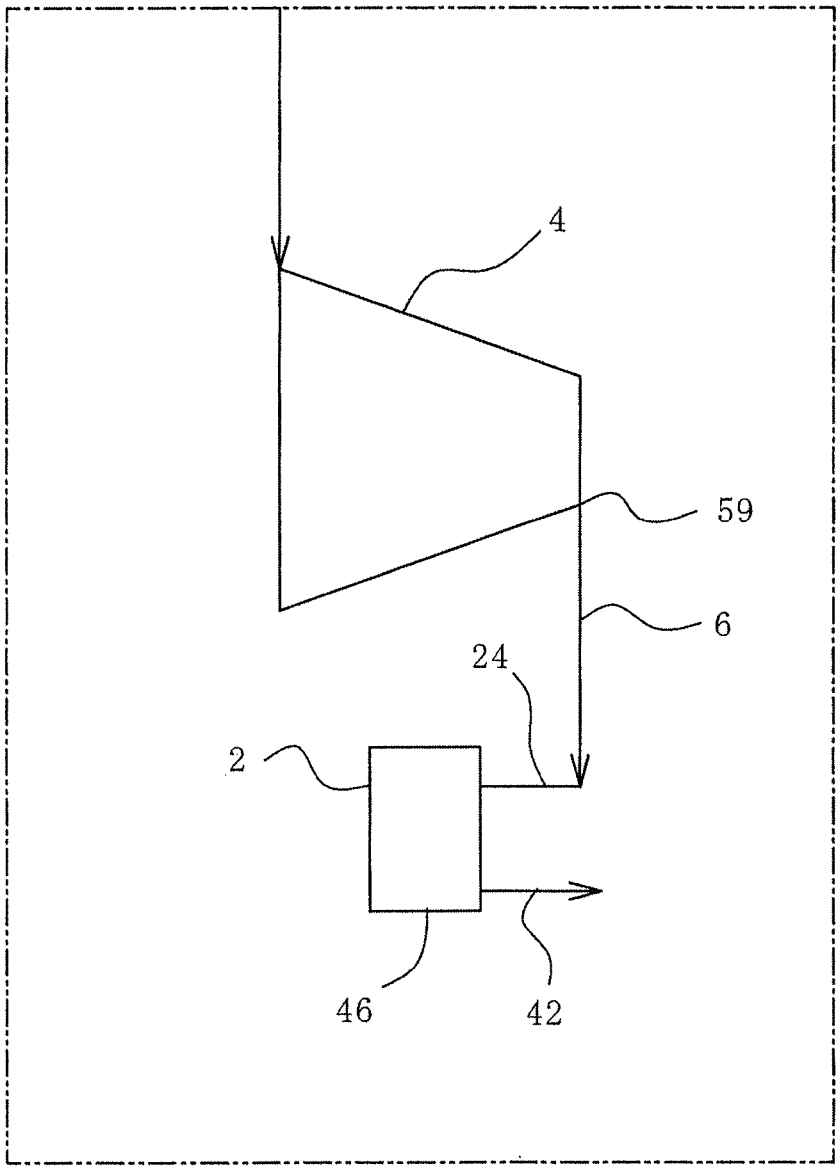
FIG. 1 is a schematic diagram illustrating a part of a device to which a sound deadening device of a first embodiment of the present invention is applied.

FIG. 1 is a schematic view illustrating a part of a device (screw compressor) to which a sound deadening device 2 of a first embodiment is applied. The sound deadening device 2 is incorporated in a flow passage through which a sound wave is superimposed on a flow of fluid to be propagated. In this embodiment, in order to deaden sound generated by circulation of compressed air as the fluid, the sound deadening device 2 is disposed in a discharge flow passage 6 of a screw compressor body 4.

A configuration of the sound deadening device 2 of the first embodiment will be described with reference to FIG. 2.

Figure 2:
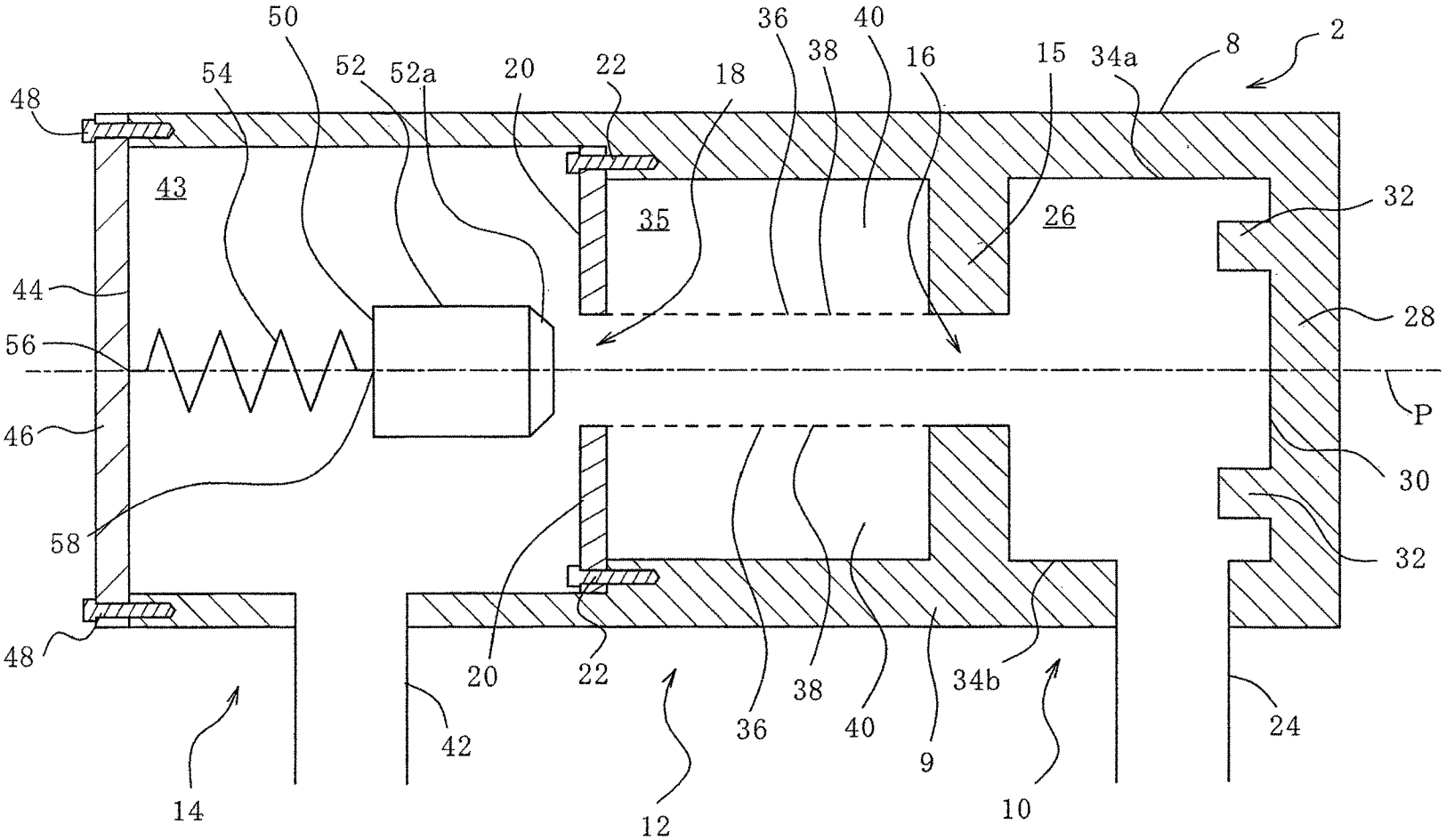
FIG. 2 is a longitudinal cross sectional schematic view illustrating the sound deadening device of the first embodiment of the present invention.

FIG. 2 is a longitudinal cross sectional schematic view illustrating the sound deadening device 2 of the first embodiment. As illustrated in FIG. 2, in the sound deadening device 2, a sound deadening device body (housing) 8 is formed in a cylindrical shape with an axis P as a center so as to circulate compressed air (fluid) therein. The sound deadening device body 8 has a side wall 9 forming a cylindrical side surface, an upstream side end of the side wall 9 is blocked by a circular blocking section 28, and a circular opening 44 is provided in a facing downstream side end. The opening 44 is blocked by a detachable lid (valve holder) 46. The outer shape of the lid 46 is substantially the same as the opening 44 of the sound deadening device body 8, and is fastened to the sound deadening device body 8 by use of bolts 48.

In the sound deadening device body 8, a partition wall 15 that projects radially inward from the side wall 9 is provided at a position separated from the blocking section 28 in the direction of the axis P (left in the figure) by a predetermined distance (e.g., about ⅓ of an overall length). In the partition wall 15, a first intermediate communication section (lead-out section) 16 which is a circular through hole concentric with the axis P as viewed from the direction of the axis P is formed. Additionally, an annular partition section 20 is disposed between the partition wall 15 and the opening 44 so as to be concentric with the axis P. The partition section 20 has a second intermediate communication section 18 which is a circular through hole concentric with the axis P as viewed from the direction of the axis P, and is detachably fastened to the sound deadening device body 8 by using bolts 22.

Inside the sound deadening device body 8, an introducing and damping section 10, an adjacent damping section 12, and a discharging and damping section 14 are provided in order from the upstream side to the downstream side in the direction of the axis P. The introducing and damping section 10 and the adjacent damping section 12 are partitioned by the partition wall 15, and share the first intermediate communication section 16 which communicates these. Additionally, the adjacent damping section 12 and the discharging and damping section 14 are partitioned by the partition section 20, and share the second intermediate communication section 18 which communicates these. In this embodiment, the sound deadening device body 8 is formed in the cylindrical shape, but may be formed in a polygonal cylindrical shape.

The introducing and damping section 10 includes a circular introduction section 24 that is disposed at an uppermost stream, and introduces compressed air in the direction orthogonal to the axis P, and an expansion chamber 26 that is communicated with the introduction section 24 and the first intermediate communication section 16. The introduction section 24 is disposed in the sound deadening device body 8 other than an end in the direction of the axis P of the expansion chamber 26, namely, in the side wall 9. The expansion chamber 26 is defined by respective inner surfaces of the side wall 9, the blocking section 28, and the partition wall 15, and has a flow passage cross-section larger than respective flow passage cross-sections of the introduction section 24 and the first intermediate communication section 16. On an inner wall surface of the blocking section 28, a flat surface 30 orthogonal to the axis P, and protrusions (non-flat sections) 32 having such a shape as to project in the direction of the axis P from the flat surface 30 (left in the figure) are formed.

Figure 3:
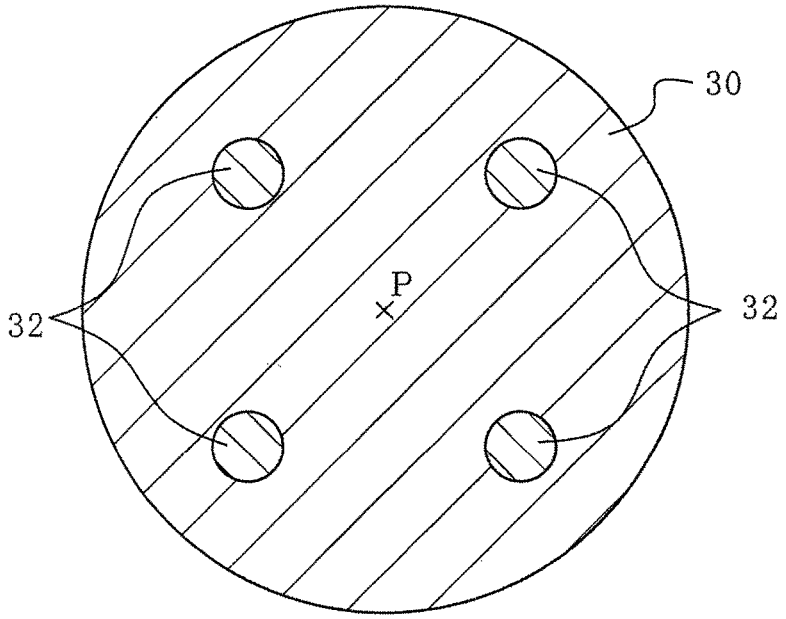
FIG. 3 is a transverse cross sectional schematic view when a flat surface and protrusions in FIG. 2 are viewed from the axial direction.

FIG. 3 is a transverse cross sectional schematic view when the flat surface 30 and the protrusions 32 are viewed from the direction of the axis P. As illustrated in FIG. 2 and FIG. 3, the four columnar protrusions 32 are disposed in this embodiment. The four protrusions 32 are disposed at equal intervals on a circumference with the axis P as a center, which has a diameter of about ¾ of the inner diameter of the expansion chamber 26. In such placement of the protrusions 32 on the inner wall surface of the blocking section 28, the protrusions 32 are disposed such that the formation area of the protrusions 32 is not more than a half of the non-formation area of the protrusions 32 (i.e., area of the flat surface 30).

In a case where this area relation is satisfied, placement is not limited to the placement illustrated in FIG. 3, but may be arbitrary placement. Preferably, in the placement of the protrusions 32, a part of the protrusions 32 may be disposed at a center between the facing surfaces 34*a*, 34*b* in the vertical direction (compressed fluid introduction direction in the introduction section 24) in FIG. 2. This is because the vicinity of the center between the facing surfaces 34*a*, 34*b* is far from the wall surfaces 34*a*, 34*b*, and therefore particle velocity becomes faster, and a larger interference effect can be expected. In a case where the sound deadening device body 8 is cylindrical like this embodiment, the facing surfaces 34*a*, 34*b* are substantially one surface. However, in this case, the facing surfaces 34*a*, 34*b* indicate an upper part and a lower part in the inner wall surface of the expansion chamber 26. That is, in this embodiment, the protrusions 32 are preferably disposed so as to include the center axis P of the cylindrical shape which is the center between the upper part and the lower part in the inner wall surface of the expansion chamber 26.

In this embodiment, the four protrusions 32 are provided. However, the number of the protrusions 32 is not limited to this, and may be one or a plural number. The shape of each protrusion 32 is not limited to the columnar shape, and may be a polygon such as a triangle and a square, a ring-shaped column body, or a pyramid.

Figure 4:
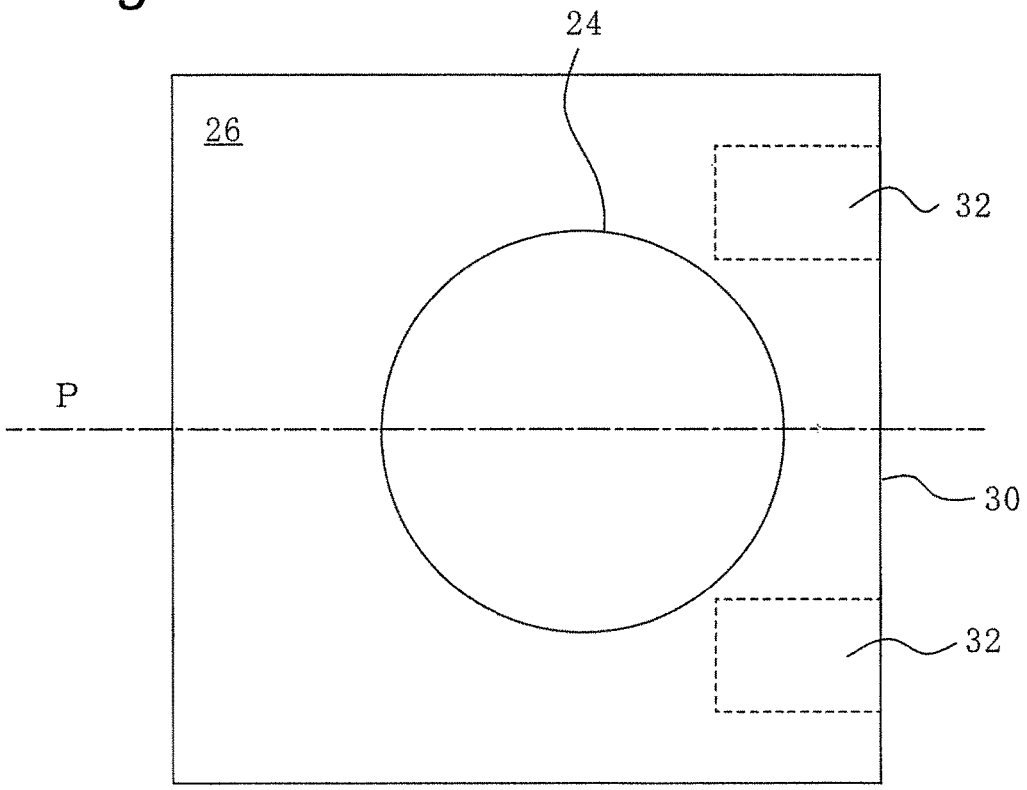
FIG. 4 is a schematic view when an expansion chamber of an introducing and damping section is viewed from an inflow section.

FIG. 4 is a schematic view when the expansion chamber 26 of the introducing and damping section 10 is viewed from the introduction section 24. As illustrated in FIG. 4, the height of each protrusion 32 (protruding amount in the direction of the axis P) is set so as not to interfere with compressed air introduced from the introduction section 24. That is, the circular shape of the introduction section 24 and the square shapes of the protrusions 32 do not interfere with each other as viewed from the direction in which compressed air is introduced from the introduction section 24. In this embodiment, the height of each protrusion 32 is set to about ⅕ of the length in the direction of the axis P of the expansion chamber 26.

In this embodiment, the four protrusions 32 have the same height. However, the height of each protrusion 32 only needs not to interfere with compressed air introduced from the introduction section 24, the protrusions 32 may have the different heights, and some of the protrusions 32 may have the same height. The protrusions 32 are preferably formed integrally with the sound deadening device body 8, but may be separately formed, and the materials of the protrusions may not be particularly limited. The protrusions 32 are disposed only on the inner wall surface of the blocking section 28 (end of the sound deadening device 2), but are preferably disposed on a surface which is located on a side close to the first intermediate communication section 16 and faces the protrusions 32 in the expansion chamber 26 of the introducing and damping section 10. Consequently, further sound deadening effect can be expected.

With reference to FIG. 2, the adjacent damping section 12 is disposed adjacent to the introducing and damping section 10 and the discharging and damping section 14. That is, the adjacent damping section 12 is disposed between the introducing and damping section 10 and the discharging and damping section 14. The adjacent damping section 12 includes an expansion chamber 35 communicated with the first intermediate communication section 16 and the second intermediate communication section 18 in the direction of the axis P. The expansion chamber 35 of the adjacent damping section 12 is defined by respective inner surfaces of the side wall 9, the partition wall 15, and the partition section 20, and has a flow passage cross-section larger than respective flow passage cross-sections of the first intermediate communication section 16 and the second intermediate communication section 18.

The expansion chamber 35 of the adjacent damping section 12 is a sound absorption chamber having a porous plate 36. The porous plate 36 is formed of metal such as iron and aluminum, or synthetic resin. The porous plate 36 extends in the direction of the axis P between the first intermediate communication section 16 and the second intermediate communication section 18, and disposed on the radially outside of the first intermediate communication section 16 and the second intermediate communication section 18. That is, the porous plate 36 divides the expansion chamber 35 radially. In the porous plate 36, a plurality of through holes 38 through which compressed air passes extend in the direction of the axis P. A back air layer 40 is formed in a space of the expansion chamber 35, the space being on the radially outside of the porous plate 36 and on the radially inside of the sound deadening device body 8.

Pressure damping due to viscous friction of a medium (such as air) and the inner wall surface inside the through holes 38 to a sound wave is generated by the porous plate 36 having the through holes 38 and the back air layer 40. Furthermore, pressure damping due to a whirl generated when the medium is jetted from the through holes 38 is also generated. Consequently, a sound absorbing effect is exerted. Particularly, as to the pressure damping due to the viscous friction with the inner wall surface, the effect is large with respect to sound having a resonance frequency, and the resonance frequency can be arbitrarily designed by the thickness of the back air layer 40, the cross-sectional areas or the aperture ratios of the through holes 38, and the plate thickness of the porous plate 36. In this embodiment, the porous plate 36 and the back air layer 40 are formed. However, in place of these, a sound absorbing material made of porous material such as glass wool and rock wool may be used. In addition to this, in a case where a use environment is at a high temperature, a metal fiber material such as iron and stainless steel may be used.

With reference to FIG. 2, the discharging and damping section 14 is disposed at a lowermost stream, and includes a circular discharge section 42 that leads out compressed air in the direction orthogonal to the axis P, and an expansion chamber 43 that is communicated with the discharge section 42 and the second intermediate communication section 18. The discharge section 42 is disposed in the sound deadening device body 8 other than an end in the direction of the axis P of the expansion chamber 43, that is, disposed in the side wall 9. The expansion chamber 43 of the discharging and damping section 14 is defined by respective inner surfaces of the side wall 9, the partition section 20, and the lid 46, and has a flow passage cross-section larger than respective flow passage cross-sections of the discharge section 42 and the flow passage cross-section of second intermediate communication section 18. The lid 46 is provided with a valve section 50 capable of blocking the second intermediate communication section 18. In this embodiment, the lead-out direction of compressed air in the discharge section 42 is the direction orthogonal to the axis P. However, the lead-out direction is not limited to this, and compressed air may be led out, for example, in the direction inclined to the axis P.

The valve section 50 includes a valve body 52 and an urging member 54. The valve section 50 is disposed coaxially with the axis P. A forward end part 52*a* in the direction of the axis P presses the second intermediate communication section 18, so that the valve body 52 can block the second intermediate communication section 18. The valve section 50 has a first end 56 fixed to the lid 46, and a second end 58 fixed to the valve body 52. The urging member 54 has such size as to elastically urge the valve body 52 in the direction of the axis P, and block the second intermediate communication section 18 by the valve body 52, in a state where the lid 46 is mounted on the opening 44 of the sound deadening device body 8.

Now, action of the sound deadening device 2 of the first embodiment will be described.

With reference to FIG. 1 and FIG. 2, when the screw compressor is operated, compressed air is discharged from a discharge port 59 of the screw compressor body 4 to the discharge flow passage 6, and the compressed air is introduced from the introduction section 24 to the sound deadening device 2 in the direction orthogonal to the axis P. Accordingly, a sound wave generated in the outlet space of the compressor can be damped, and sound can be deadened. The travelling direction of the compressed air introduced from the introduction section 24 to the expansion chamber 26 is bent in the direction of the axis P inside the expansion chamber 26, and flows from the first intermediate communication section 16 to the adjacent damping section 12.

When the compressed air is introduced from the introduction section 24 to the expansion chamber 26, the flow passage cross-sectional area of the compressed air is increased. That is, since impedance rapidly changes, a sound wave is reflected inside the introducing and damping section 10 to be damped. More specifically, the sound wave is reflected on a boundary between the introduction section 24 and the expansion chamber 26, and a boundary between the first intermediate communication section 16 and the expansion chamber 26 to be damped. Thus, the expansion chamber 26 is provided to change the flow passage cross-sectional area, so that the compressed air can damp sound generated when the compressed air circulates. The introducing and damping section 10 of this embodiment is a low-frequency side damping section that damps a sound wave in a low frequency range.

In the introducing and damping section 10, the protrusions 32 are provided on the inner wall surface of the blocking section 28, so that it is possible to weaken the resonance of a sound wave, suppress rise of inner sound pressure of the sound deadening device 2, and prevent reduction in a sound deadening effect. Generally, in such a sound deadening device 2, compressed air introduced from the introduction section 24 generates resonance having a predetermined frequency between the facing surfaces 34*a*, 34*b* of the expansion chamber 26. This resonance having the predetermined frequency occurs when a half-wavelength $\frac{1}{2}\lambda$ of a wavelength $\lambda$ of a sound wave coincides with a distance between the facing surfaces 34*a*, 34*b*, or its integer multiples. In these cases, the sound deadening effect is lowered. In this embodiment, the protrusions 32 interfere with the sound wave having the frequency at which this resonance is caused, so that it is possible to suppress the resonance. Accordingly, it is possible to suppress rise in the inner sound pressure, and lower the sound deadening effect.

When the protrusions 32 exist in the flow passage of compressed air, the protrusions become obstacles to the flow, and therefore there is a fear that a pressure loss increases. In order to prevent this, the height of each protrusion 32 is set to be less than such a height so as not to interfere with the flow passage, so that it is possible to prevent increase of the pressure loss (refer to FIG. 4).

In the inner wall surface of the blocking section 28, the formation area of the protrusions 32 is set to be not more than a half of the non-formation area (i.e., area of the flat surface 30) (refer to FIG. 3), so that it is possible to hold the original frequency characteristic of the expansion chamber 26. The original frequency characteristic of the expansion chamber 26 means a sound deadening characteristic due to interference of a sound wave in the direction of the axis P. When the formation area of the protrusions 32 exceeds a predetermined value, the protrusions 32 themselves act as wall surfaces, and therefore the original frequency characteristic of the expansion chamber 26 is lost (changes).

In a case where a part of the protrusions 32 is provided at the central position between the facing surfaces 34*a*, 34*b* in the vertical direction, which causes resonance, it is possible to more effectively suppress the resonance in the expansion chamber 26. Particle velocity is the fastest at the central position between the facing surfaces 34*a*, 34*b*, and therefore a larger sound deadening effect can be exerted by interference and action of the protrusions 32.

Figure 5:
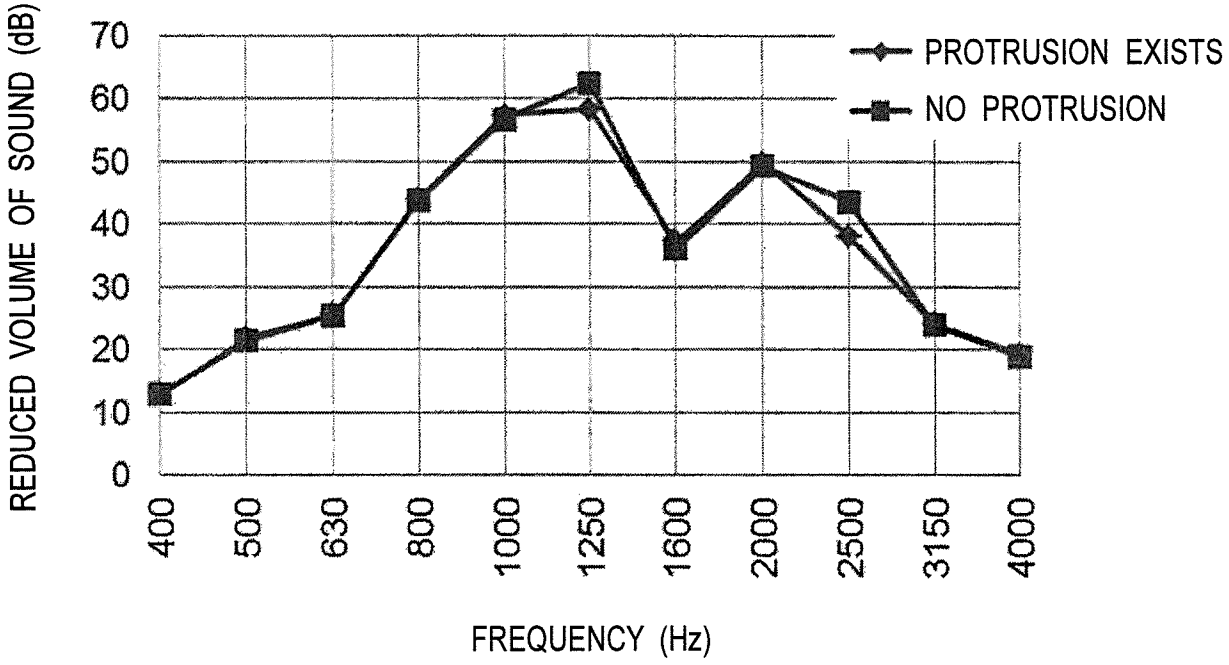
FIG. 5 is a graph illustrating reduced volume of the sound deadening device due to the presence or absence of the protrusions.

FIG. 5 is a graph illustrating reduced volume of the sound deadening device due to the presence or absence of the protrusions 32. As illustrated in FIG. 5, the protrusions 32 are provided, so that resonance is weakened at frequencies (1250 Hz and 2500 Hz) at which resonance is generated in the expansion chamber 26, and reduced volume is increased.

With reference to FIG. 2, in the adjacent damping section 12, compressed air that flows from the first intermediate communication section 16 passes through a plurality of the through holes 38. At this time, pressure damping due to viscous friction of compressed air in the through holes 38 and the inner wall surface is generated, and pressure damping due to a whirl generated when the compressed air is jetted from the through holes 38 is further generated, so that the sound absorbing effect is exerted. Thereafter, compressed air in the back air layer 40 region passes through the plurality of through holes 38 to be returned into the porous plate 36, and joins compressed air that flows from the second intermediate communication section 18 into the discharging and damping section 14. The adjacent damping section 12 of this embodiment is a high-frequency side damping section that damps a sound wave in a high frequency range. Particularly, the sound wave in the high frequency range sometimes slips in a beam form, and therefore a sufficient sound deadening effect cannot be obtained in a structure in which compressed air travels in a single direction. The direction of the flow passage is changed by the introducing and damping section 10, and therefore the direction of sound is changed, and the sound wave can be made incident upon porous plate 36 with an angle. Consequently, even high-frequency sound can be reduced.

Thus, compressed air, in which sound waves in the low frequency range and the high frequency range are damped, passes through the second intermediate communication section 18, presses down the valve body 52 of the valve section 50 toward the opening 44 against urging force of the urging member 54, and flows into the expansion chamber 43 of the discharging and damping section 14, the flow passage cross-sectional area of which is larger.

In the discharging and damping section 14, in the compressed air that flows from the second intermediate communication section 18, a sound wave in a low frequency range particularly is reflected inside the discharging and damping section 14 to be damped, similarly to a case where compressed air is introduced into the introducing and damping section 10. Thus, the flow passage cross-sectional area is changed, so that it is possible to damp a sound wave that is generated when compressed air is generated, and that is propagated downstream. Accordingly, the discharging and damping section 14 is a low-frequency side damping section that damps a sound wave in the low frequency range. Then, the travelling direction for allowing circulation in the direction of the axis P is bent in the direction orthogonal to the direction of the axis P, and the compressed air is led out from the discharge section 42.

According to these configurations, the valve section 50 is disposed inside the discharging and damping section 14 located at a lowermost stream, and therefore the sound deadening device 2 can be made compact. Additionally, a plurality of the damping sections 10, 12, 14 are disposed in the compressed air flow direction, and the first intermediate communication section 16 and the second intermediate communication section 18 are provided between the respective damping sections, so that it is possible to damp a sound wave in a wide frequency range. Additionally, the valve section 50 capable of blocking the second intermediate communication section 18 is provided in the valve holder 46 of the sound deadening device body 8, and therefore it is possible to prevent a reverse flow of compressed air. The valve section 50 is provided in the valve holder 46 that is detachably attached to the sound deadening device body 8, and the discharge section 42 is provided in a part other than the valve holder 46 of the sound deadening device body 8, and therefore the valve section 50 can be maintained without detaching a pipe disposed on the downstream side of the discharge section 42. That is, it is possible to damp the sound wave in the wide frequency range, and easily maintain the valve section 50 for preventing the reverse flow of compressed air, with a compact structure.

(Second Embodiment)

Figure 6:
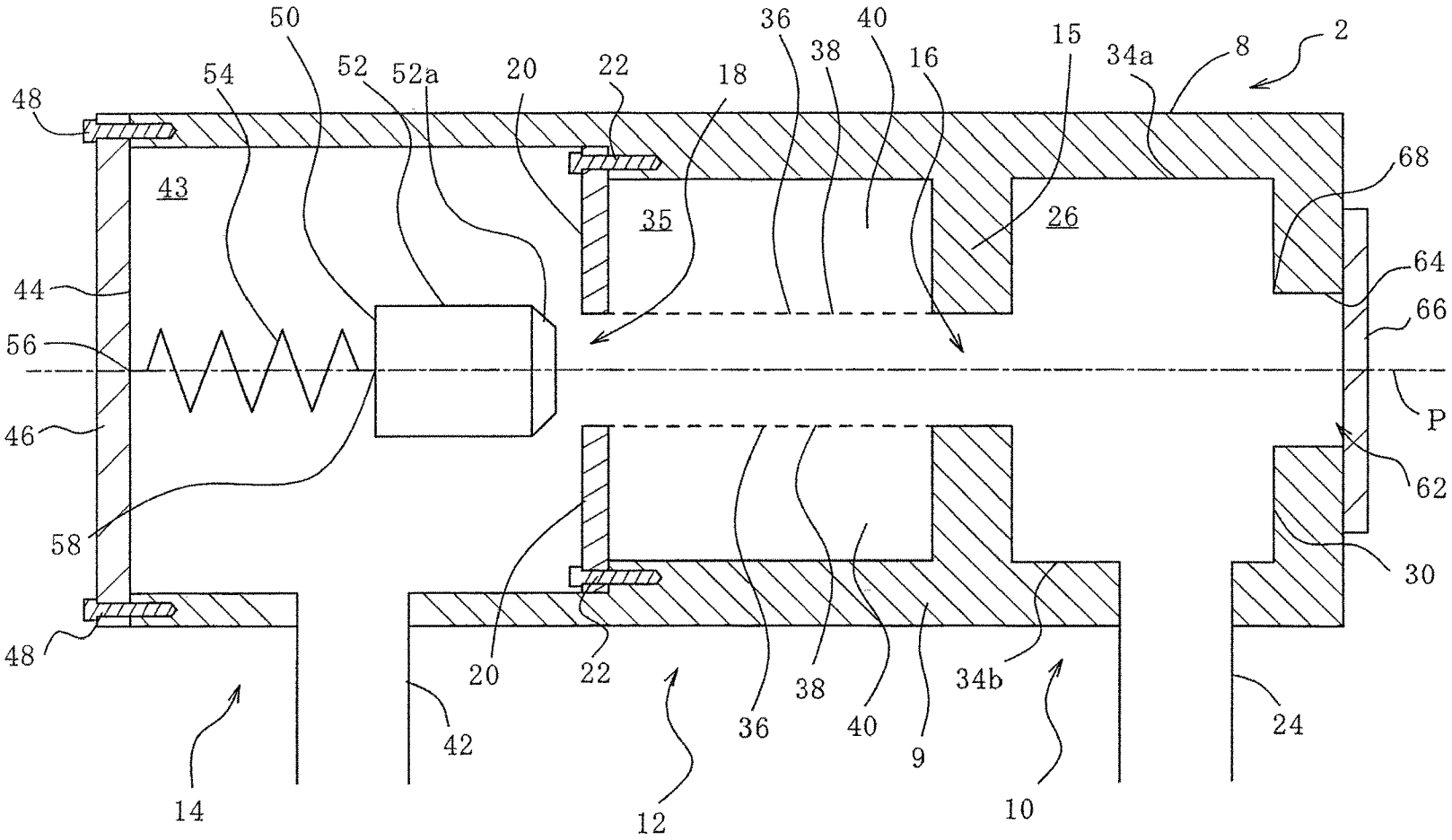
FIG. 6 is a longitudinal cross sectional schematic view illustrating a sound deadening device of a second embodiment of the present invention.

FIG. 6 is a longitudinal cross sectional schematic view illustrating a sound deadening device 2 of a second embodiment. A configuration of the sound deadening device 2 of this embodiment is similar to the configuration of the sound deadening device of the first embodiment in FIG. 2, except for a part related to an end of an introducing and damping section 10. Accordingly, components similar to the components illustrated in FIG. 1 are denoted by the same reference numerals, and description thereof will be omitted.

As illustrated in FIG. 6, in the sound deadening device 2 of the second embodiment, a recess (non-flat section) 62 and a flat surface 30 are formed in an end in the direction of an axis P of an expansion chamber 26 of the introducing and damping section 10. A recess 62 is composed of a circular hole 64 that penetrates a sound deadening device body 8, and a blocking plate 66 that blocks the hole 64. Accordingly, the end in the direction of the axis P of the introducing and damping section 10 does not have the blocking section 28 like the first embodiment, but has an opening 68 that is opened by the hole 64.

The recess 62 is provided, so that it is possible to weaken resonance inside the expansion chamber 26, suppress rise of inner sound pressure of the sound deadening device 2, and prevent reduction in a sound deadening effect, similarly to the protrusions 32 of the first embodiment. Additionally, the recess 62 is provided, so that an effect of a side branch is added.

The recess 62 is composed of the hole 64 and the blocking plate 66, so that, for example, in a case where the sound deadening device body 8 is manufactured by casting, the blocking plate 66 is detached, and sand and the like in the expansion chamber 26 can be discharged from the hole 64. Additionally, even after the sound deadening device 2 is assembled, and installed in a unit, a stick 70 or the like is inserted into each section from the hole 64, so that, for example, it is possible to confirm a state and operation of the valve section 50 (refer to FIG. 7).

Figure 8:
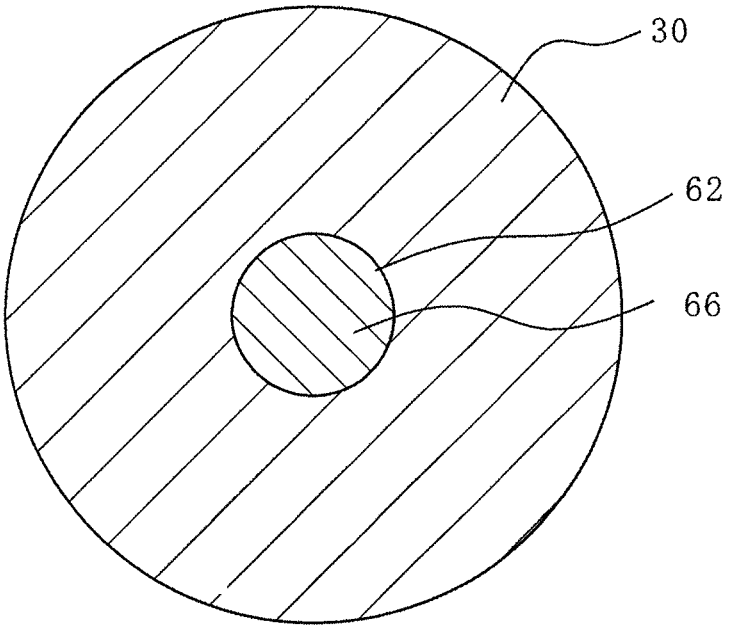
FIG. 8 is a transverse cross sectional schematic view when a flat surface and a recess in FIG. 6 are viewed from the axial direction.

FIG. 8 is a transverse cross sectional schematic view when the flat surface 30 and the recess 62 in FIG. 6 are viewed from the direction of the axis P. As illustrated in FIG. 6 and FIG. 8, the recess 62 is disposed coaxially with the axis P at a center between facing surfaces 34*a*, 34*b* in the vertical direction (fluid introduction direction in an introduction section 24) in FIG. 6 of the expansion chamber 26. In such placement of the recess 62 on an inner wall surface of the opening 68, the recess 62 is disposed such that the formation area of the recess 62 is not more than a half of the non-formation area (i.e., area of the flat surface 30) of the recess 62.

Figure 7:
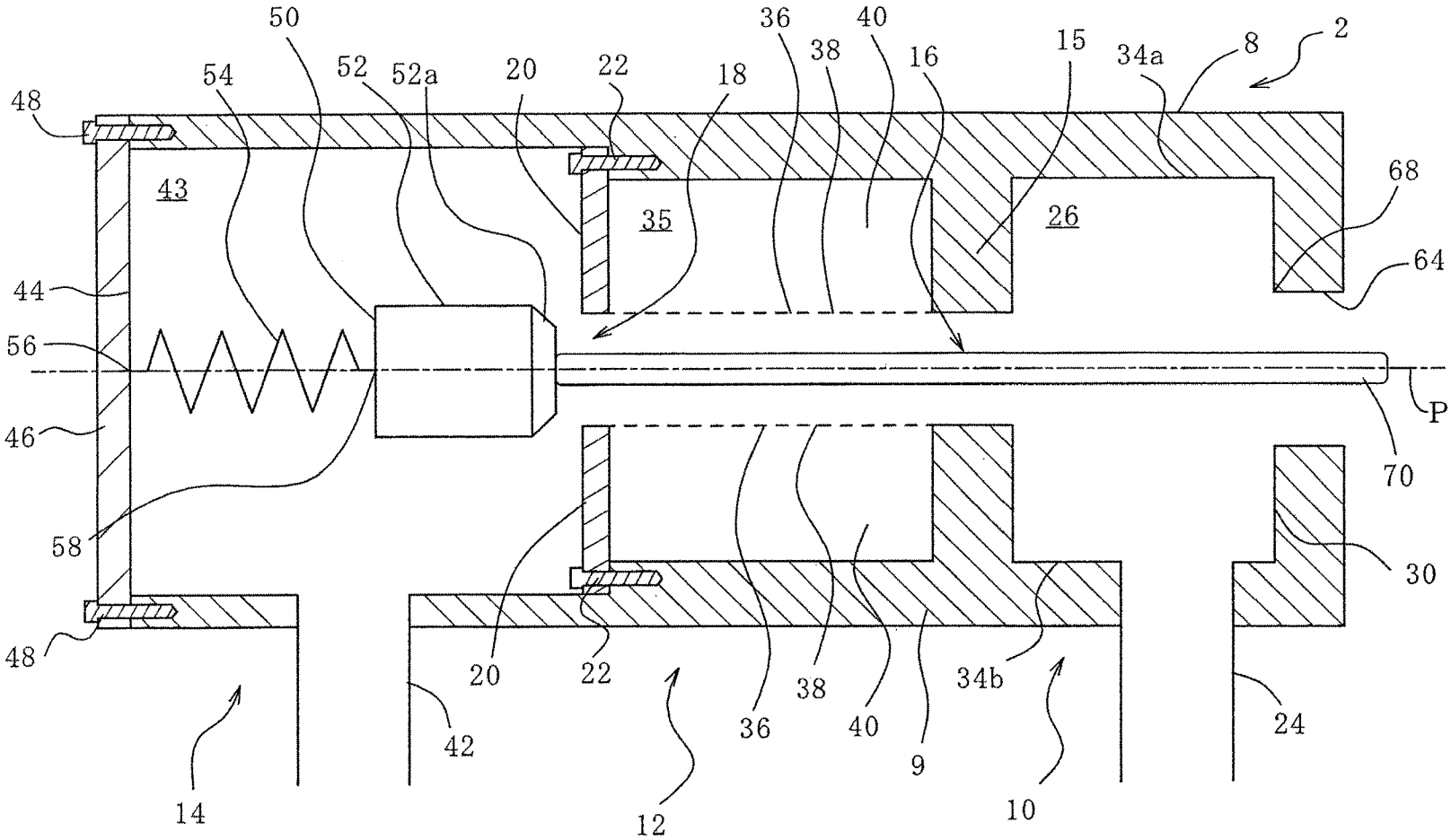
FIG. 7 is a view illustrating an example of detaching a blocking plate in FIG. 6 to perform maintenance.

In a case where this area relation is satisfied, the placement of the recess 62 is not limited to the placement illustrated in FIG. 7, but may be arbitrary placement. However, a part of the recess 62 is preferably disposed at the center between the facing surfaces 34*a*, 34*b* of the expansion chamber 26 like this embodiment. In this embodiment, the one recess 62 is provided. However, the number of recesses 62 is not limited to this, and may be one or a plural number. The shape of the recess 62 is not limited to the circular shape, and may be a polygon such as a triangle and a square, a ring-shaped column body, or a pyramid.

(Third Embodiment)

Figure 9:
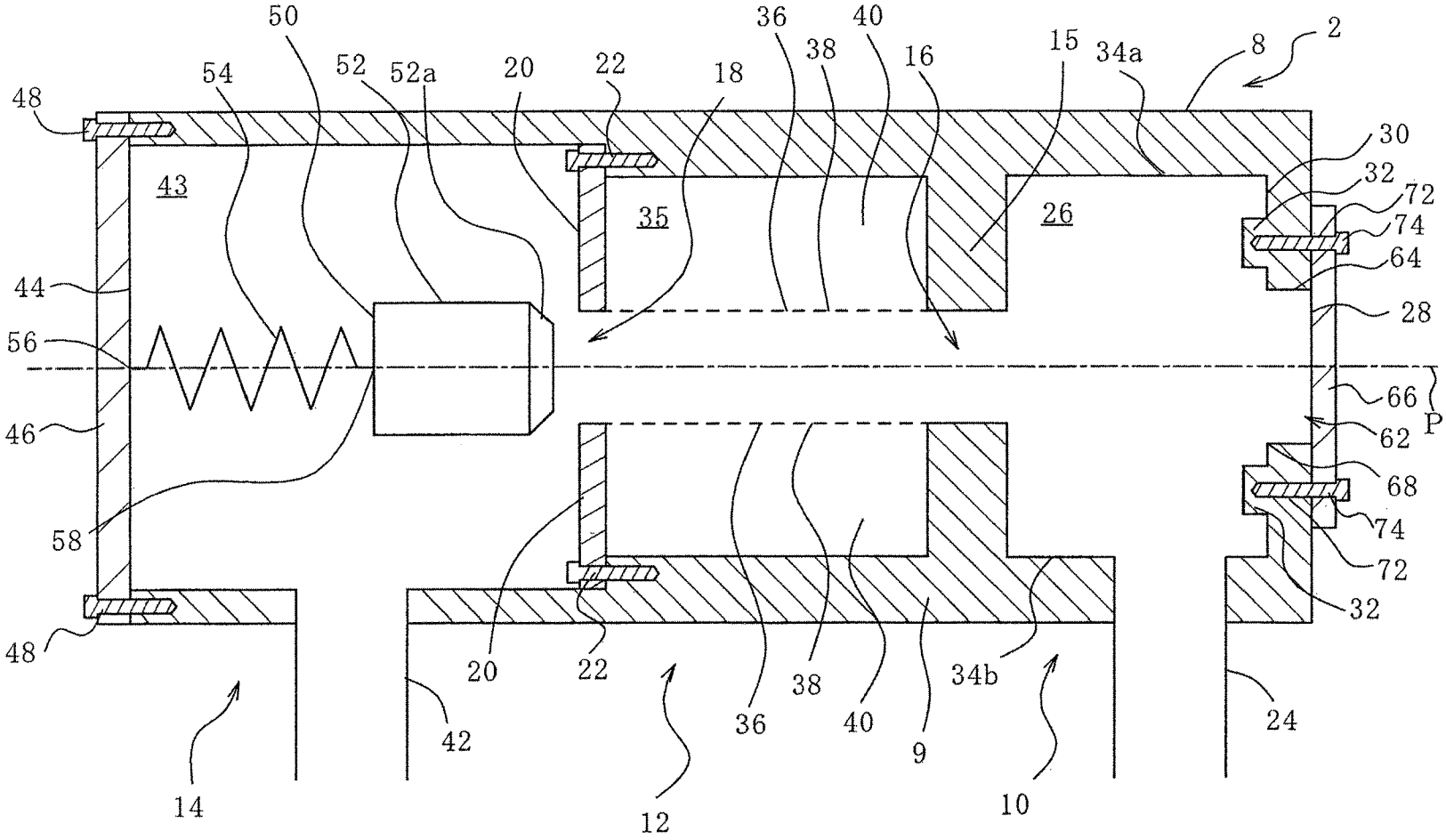
FIG. 9 is a longitudinal cross sectional schematic view illustrating a sound deadening device of a third embodiment of the present invention.

FIG. 9 is a longitudinal cross sectional schematic view illustrating a sound deadening device 2 of a third embodiment. A configuration of the sound deadening device 2 of this embodiment is similar to the configuration of the sound deadening device of the first embodiment in FIG. 2, except for a part related to an end of an introducing and damping section 10. Accordingly, components similar to the components illustrated in FIG. 1 are denoted by the same reference numerals, and description thereof will be omitted.

As illustrated in FIG. 9, the sound deadening device 2 of the third embodiment has protrusions (non-flat sections) 32 and a recess (non-flat section) 62 in the introducing and damping section 10. The recess 62 is composed of a circular hole 64 that penetrates a sound deadening device body 8, and a blocking plate 66 that blocks a hole 64. Accordingly, the end of the introducing and damping section 10 does not have the blocking section 28 like the first embodiment, but has an opening 68 that is opened by the hole 64 like the second embodiment.

Thus, a part for suppressing resonance in the introducing and damping section 10 may be a form in which protrusions 32 and the recess 62 are combined. This is because even in a case where the protrusions 32 and the recess 62 are combined, the protrusions 32 and the recess 62 interfere with a sound wave causing resonance in an expansion chamber 26 to suppress the resonance, similarly to the case of the protrusions 32 of the first embodiment and the case of recess 62 of the second embodiment.

Inside each protrusion 32, a screw hole 72 for fixing the blocking plate 66 is provided. With this configuration, it is possible to fix the blocking plate with bolts 22 by sufficiently hooking threads without increasing the thickness of the sound deadening device body 8. Additionally, the height of each protrusion 32 (protruding amount in the direction of an axis P) is set so as not to interfere with compressed air introduced from an introduction section 24, similarly to the first embodiment.

Figure 10:
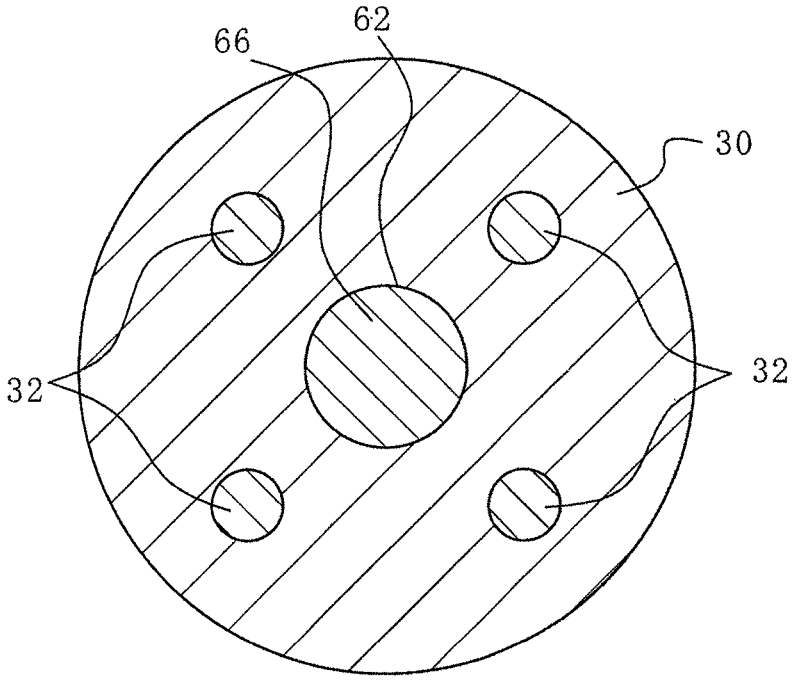
FIG. 10 is a transverse cross sectional schematic view when a flat surface, protrusions, and a recess in FIG. 9 are viewed from the axial direction.

FIG. 10 is a transverse cross sectional schematic view when a flat surface 30, the protrusions 32, and the recess 62 in FIG. 9 are viewed from the direction of the axis P. As illustrated in FIG. 9 and FIG. 10, the recess 62 is disposed coaxially with the axis P at a center between facing surfaces 34*a*, 34*b* in the vertical direction of the expansion chamber 26. In such placement of the protrusions 32 and the recess 62 on an inner wall surface of the opening 68, the protrusions 32 and the recess 62 are disposed such that the formation area of the protrusions 32 and the recess 62 is not more than a half of the non-formation area (area of the flat surface 30) of the protrusions 32 and the recess 62.

In a case where this area relation is satisfied, the placement of the protrusions 32 and the recess 62 is not limited to the placement illustrated in FIG. 10, but may be arbitrary placement. However, a part of the protrusions 32 or the recess 62 is preferably disposed at the center between the facing surfaces 34*a*, 34*b* of the expansion chamber 26. In this embodiment, the four protrusions 32 and the one recess 62 are provided. However, the number of the protrusions 32 and the number of recess 62 are not limited to this, and may be one or a plural number. The shape of each of the protrusions 32 and the recess 62 is not limited to the circular shape, and may be a polygon such as a triangle and a square, a ring-shaped column body, or a pyramid.

In the first to third embodiments, the protrusions 32 or the recess 62 are disposed on the surface along the compressed air introduction direction. However, the placement place is not limited to this, and only needs to be a surface along the travelling direction of a sound wave, resonance of which is to be suppressed. Accordingly, for example, the placement place may be a surface facing the introduction direction (facing surfaces 34*a*, 34*b*) or the like.

In the first to third embodiments, the sound deadening device 2 including the three damping sections, namely, the introducing and damping section 10, the adjacent damping section 12, the discharging and damping section 14 is described. However, for example, even when the sound deadening device includes only the introducing and damping section 10, a sound deadening effect can be expected. Accordingly, a plurality of damping sections is not always needed, and the sound deadening device may include only one damping section.

In the above embodiment, a compressor is exemplified. However, the sound deadening device 2 may be incorporated in, for example, a vehicle having an engine and the like, a railroad vehicle, a ship, or the like, other than the compressor.

The invention claimed is:

1. A sound deadening device, comprising:

an introducing and damping section that damps a sound wave, resonance of the sound wave being to be suppressed, the introducing, and damping section including:

an introduction section that introduces fluid;

an expansion chamber that is communicated with the introduction section, has a flow passage cross-section larger than a flow passage cross-section of the introduction section, and has a non-flat section on a surface along a travelling direction of the sound wave; and a lead-out section that is communicated with the expansion chamber, has a flow passage cross-section smaller than the flow passage cross-section of the expansion chamber, and leads out the fluid in a direction different from an introduction direction of the fluid, wherein the non-flat section includes a recess, and the recess is composed of a hole, and a blocking plate that blocks the hole.

2. The sound deadening device according to claim 1, wherein the non-flat section includes a protrusion.

3. The sound deadening device according to claim 2, wherein a height of the protrusion is such a height so as not to interfere with a flow passage of the fluid as viewed from the introduction direction of the fluid.

4. The sound deadening device according to claim 2, wherein a screw hole for fixing the blocking plate is provided in the protrusion.

5. The sound deadening device according to claim 1, wherein an area where the non-flat section is formed is not more than a half of an area where the non-flat section is not formed in an inner wall surface where the non-flat section is formed.

6. The sound deadening device according to claim 1, wherein a part of the non-flat section is provided at a center between facing surfaces forming the expansion chamber in the introduction direction of the fluid.

7. The sound deadening device according to claim 1, comprising a plurality of damping sections for sound that are disposed in a flow direction of the fluid, wherein the damping section located at an uppermost stream among the plurality of damping sections is the introducing and damping section, the damping section located at a lowermost stream among the plurality of damping sections is a discharging and damping section, and the discharging and damping section includes:

a second intermediate communication section that is a portion communicated with an adjacent damping section adjacent to the discharging and damping section;

a valve section that is disposed in the discharging and damping section, and is capable of blocking the second intermediate communication section;

an urging member that elastically urges the valve section in a direction in which the second intermediate communication section is closed;

a valve holder that holds the valve section, and is detachably attached to a housing including the plurality of damping sections; and a discharge section that is provided at a portion different from the valve holder, and leads out the fluid from the discharging and damping section.

8. The sound deadening device according to claim 4, wherein an area where the non-flat section is formed is not more than a half of an area where the non-flat section is not formed in an inner wall surface where the non-flat section is formed.

9. The sound deadening device according to claim 4, wherein a part of the non-flat section is provided at a center between facing surfaces forming the expansion chamber in the introduction direction of the fluid.

10. The sound deadening device according to claim 4, comprising a plurality of damping sections for sound that are disposed in a flow direction of the fluid, wherein the damping section located at an uppermost stream among the plurality of damping sections is the introducing and damping section, the damping section located at a lowermost stream among the plurality of damping sections is a discharging and damping section, and the discharging and damping section includes:

a second intermediate communication section that is a portion communicated with an adjacent damping section adjacent to the discharging and damping section;

a valve section that is disposed in the discharging and damping section, and is capable of blocking the second intermediate communication section;

an urging member that elastically urges the valve section in a direction in which the second intermediate communication section is closed;

a valve holder that holds the valve section, and is detachably attached to a housing including the plurality of damping sections; and a discharge section that is provided at a portion different from the valve holder, and leads out the fluid from the discharging and damping section.

* * * * *